US009845939B2

(12) United States Patent
Kim

(10) Patent No.: US 9,845,939 B2
(45) Date of Patent: Dec. 19, 2017

(54) LIGHT EMITTING DEVICE

(71) Applicant: SAMSUNG ELECTRONICS CO., LTD., Suwon-si (KR)

(72) Inventor: Hyun Jung Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 271 days.

(21) Appl. No.: 14/792,842

(22) Filed: Jul. 7, 2015

(65) Prior Publication Data

US 2016/0109102 A1 Apr. 21, 2016

(30) Foreign Application Priority Data

Oct. 21, 2014 (KR) ..... 10-2014-0142897

(51) Int. Cl.

| | |
|---|---|
| ***F21V 21/005*** | (2006.01) |
| ***F21V 23/06*** | (2006.01) |
| ***F21K 9/00*** | (2016.01) |
| ***F21V 23/00*** | (2015.01) |
| *F21Y 105/16* | (2016.01) |
| *F21Y 115/10* | (2016.01) |

(52) U.S. Cl.

CPC ..... *F21V 21/005* (2013.01); *F21K 9/00* (2013.01); *F21V 23/005* (2013.01); *F21V 23/006* (2013.01); *F21V 23/06* (2013.01); *F21Y 2105/16* (2016.08); *F21Y 2115/10* (2016.08)

(58) Field of Classification Search

CPC .... F21V 21/005; F21V 23/005; F21V 23/006; F21V 23/06; F21K 9/00; F21Y 2105/16; F21Y 2115/10

USPC ..... 362/249.03

See application file for complete search history.

(56) References Cited

U.S. PATENT DOCUMENTS

| | | | |
|---|---|---|---|
| 6,372,608 | B1 | 4/2002 | Shimoda et al. |
| 6,645,830 | B2 | 11/2003 | Shimoda et al. |
| RE38,466 | E | 3/2004 | Inoue et al. |
| 6,818,465 | B2 | 11/2004 | Biwa et al. |
| 6,818,530 | B2 | 11/2004 | Shimoda et al. |
| 6,858,081 | B2 | 2/2005 | Biwa et al. |
| 6,870,148 | B2 | 3/2005 | Dietz et al. |
| 6,967,353 | B2 | 11/2005 | Suzuki et al. |
| 7,002,182 | B2 | 2/2006 | Okuyama et al. |
| 7,084,420 | B2 | 8/2006 | Kim et al. |
| 7,087,932 | B2 | 8/2006 | Okuyama et al. |

(Continued)

FOREIGN PATENT DOCUMENTS

KR 10-2014-0064239 A 5/2014

*Primary Examiner* — Laura Tso

(74) *Attorney, Agent, or Firm* — Sughrue Mion, PLLC

(57) ABSTRACT

A light emitting device includes: a plurality of light emitting modules each provided with a circuit board, and first to n-th light source groups disposed on the circuit board, n being an integer greater than two, wherein the first to n-th light source groups each include at least one light emitting diode (LED); a driving module supplying driving power to the plurality of light emitting modules, and determine a number of light source groups operating in each of the plurality of light emitting modules based on a level of the driving power; and a module connection unit connecting first to n-th light source groups provided in one of the plurality of light emitting modules and first to n-th light source groups provided in another light emitting module in parallel in a detachable manner, respectively.

19 Claims, 16 Drawing Sheets

(56) References Cited

U.S. PATENT DOCUMENTS

| | | | | |
|---|---|---|---|---|
| 7,154,124 | B2 | 12/2006 | Han et al. | |
| 7,208,725 | B2 | 4/2007 | Sherrer et al. | |
| 7,288,758 | B2 | 10/2007 | Sherrer et al. | |
| 7,319,044 | B2 | 1/2008 | Han et al. | |
| 7,445,370 | B2 | 11/2008 | Ohkawa | |
| 7,501,656 | B2 | 3/2009 | Han et al. | |
| 7,638,954 | B2 | 12/2009 | Kunimatsu et al. | |
| 7,709,857 | B2 | 5/2010 | Kim et al. | |
| 7,759,140 | B2 | 7/2010 | Lee et al. | |
| 7,781,727 | B2 | 8/2010 | Sherrer et al. | |
| 7,790,482 | B2 | 9/2010 | Han et al. | |
| 7,804,478 | B2 | 9/2010 | Schou | |
| 7,940,350 | B2 | 5/2011 | Jeong | |
| 7,959,312 | B2 | 6/2011 | Yoo et al. | |
| 7,964,881 | B2 | 6/2011 | Choi et al. | |
| 7,985,976 | B2 | 7/2011 | Choi et al. | |
| 7,994,525 | B2 | 8/2011 | Lee et al. | |
| 8,008,683 | B2 | 8/2011 | Choi et al. | |
| 8,013,352 | B2 | 9/2011 | Lee et al. | |
| 8,049,161 | B2 | 11/2011 | Sherrer et al. | |
| 8,129,711 | B2 | 3/2012 | Kang et al. | |
| 8,179,938 | B2 | 5/2012 | Kim | |
| 8,263,987 | B2 | 9/2012 | Choi et al. | |
| 8,324,646 | B2 | 12/2012 | Lee et al. | |
| 8,376,583 | B2 * | 2/2013 | Wang | F21V 23/006 362/249.02 |
| 8,399,944 | B2 | 3/2013 | Kwak et al. | |
| 8,432,511 | B2 | 4/2013 | Jeong | |
| 8,459,832 | B2 | 6/2013 | Kim | |
| 8,466,619 | B2 * | 6/2013 | Lee | H05B 33/0803 315/51 |
| 8,471,493 | B2 | 6/2013 | Yem et al. | |
| 8,471,495 | B2 | 6/2013 | Muguruma et al. | |
| 8,502,242 | B2 | 8/2013 | Kim | |
| 8,536,604 | B2 | 9/2013 | Kwak et al. | |
| 8,637,882 | B2 * | 1/2014 | Stoyan | F21S 2/005 257/98 |
| 8,735,931 | B2 | 5/2014 | Han et al. | |
| 8,766,295 | B2 | 7/2014 | Kim | |
| 2012/0096423 | A1 | 4/2012 | Chang | |
| 2012/0134155 | A1 * | 5/2012 | Wendt | F21S 2/00 362/249.03 |
| 2013/0093344 | A1 | 4/2013 | Chen et al. | |
| 2013/0169796 | A1 | 7/2013 | Van Der Burgt et al. | |
| 2013/0194806 | A1 * | 8/2013 | Smith | F21V 21/14 362/249.03 |
| 2013/0278163 | A1 | 10/2013 | Rodriquez et al. | |
| 2014/0063803 | A1 * | 3/2014 | Yaphe | F21V 15/012 362/247 |

* cited by examiner

LIGHT EMITTING DEVICE

CROSS-REFERENCE TO RELATED APPLICATION

This application claims priority from and benefit of Korean Patent Application No. 10-2014-0142897 filed on Oct. 21, 2014, with the Korean Intellectual Property Office, the disclosure of which is incorporated herein in its entirety by reference.

BACKGROUND

Apparatuses and methods consistent with exemplary embodiments relate to a light emitting device.

Demand for light emitting diodes (LED) is continuously increasing due to various advantages thereof, such as long lifespans, low power consumption, excellent initial driving performance, and high levels of vibration resistance as compared to light emitting devices based on filaments. On the other hand, since LEDs have characteristics of being driven by direct current (DC) power, light emitting devices using LEDs are commonly provided with rectifying circuits. However, such rectifying circuits may complicate the configurations of light emitting devices, or may cause mechanical issues therewith or decreases lifespans thereof.

SUMMARY

To address the above problems, there is a need for research into an alternating current (AC) direct driving scheme using, as driving power, DC power having the form of a sine wave rectified without a constant current circuit.

Exemplary embodiments of the inventive concept provide a light emitting device capable of readily changing output luminous flux, using an alternating current (AC) direct driving scheme.

According to an aspect of an exemplary embodiment, there is provided a light emitting device which may include: a plurality of light emitting modules each provided with a circuit board, and first to n-th light source groups disposed on the circuit board, n being an integer greater than two, wherein the first to n-th light source groups each include at least one light emitting diode (LED); a driving module supplying driving power to the plurality of light emitting modules, and determine a number of light source groups operating in each of the plurality of light emitting modules based on a level of the driving power; and a module connection unit connecting first to n-th light source groups provided in one of the plurality of light emitting modules to first to n-th light source groups provided in another light emitting module in parallel in a detachable manner, respectively.

The circuit boards provided in the plurality of light emitting modules, respectively, may be physically separated from one another.

The circuit board provided in each of the plurality of light emitting modules may include a wiring pattern, and the first to n-th light source groups provided in each of the plurality of light emitting modules are electrically connected to one another by the wiring pattern.

The module connection unit may include a connector disposed on the circuit board provided in each of the plurality of light emitting modules, and electrically connected to the wiring pattern provided on the circuit board.

The connector may include a plurality of connectors disposed on the circuit board provided in each of the plurality of light emitting modules.

The connector may be disposed adjacently to an edge of the circuit board provided in each of the plurality of light emitting modules.

The circuit board provided in each of the plurality of light emitting modules may have a surface on which light source groups provided in each of the plurality of light emitting modules are disposed, and the surface has a polygonal shape.

The surface may have a regular polygonal shape.

The circuit boards provided in the plurality of light emitting modules, respectively, may have substantially identical shapes to one another.

The circuit boards provided in the plurality of light emitting modules, respectively, may be arranged in a honeycomb structure.

The driving module may include a control unit controlling a path of currents applied to the plurality of light emitting modules and flowing to a ground, based on the level of the driving power.

The driving module may further include a rectifying unit rectifying externally applied AC power.

The driving module may be direct current (DC) power in a form of a sine wave.

The first to n-th light source groups provided in each of the plurality of light emitting modules may be connected to one another in series in a sequence of the first to n-th light source groups.

At least one of the plurality of light emitting modules may further include a resistor unit connected to the first to n-th light source groups in series.

The resistor unit may include a variable resistor.

Output luminous flux may be increased in proportion to a number of the light emitting modules electrically connected to one another by the module connection unit.

The driving module may be disposed on the circuit board provided in one of the plurality of light emitting modules.

According to an aspect of another exemplary embodiment, there is provided a light emitting device which may include a main module including a main board, a light source unit provided with first to n-th light source groups, n being an integer greater than two, and a driving unit supplying driving power to the light source unit; a sub-module including a sub-board physically separated from the main board, and first to n-th light source groups disposed on the sub-board and driven by the driving power supplied from the driving unit; and a module connection unit connecting the first to n-th light source groups provided in the light source unit of the main module to the first to n-th light source groups provided in the sub-module in parallel in a detachable manner, respectively, wherein the driving unit determines a number of light source groups operating in the first to n-th light source groups of the main module and a number of light source groups operating in the first to n-th light source groups of the sub-module, based on a level of the driving power.

According to still an aspect of still another exemplary embodiment, there is provided a light emitting device which may include a plurality of light emitting modules each including first to n-th light source groups, n being an integer greater than two, and physically separated from one another; a driving module supplying driving power to the plurality of light emitting modules, and determining a number of light source groups operating in each of the plurality of light emitting modules, based on a level of the driving power; and a module connection unit connecting the first to n-th light source groups provided in each of the plurality of light emitting modules to first to n-th light source groups provided in an adjacent light emitting module in parallel in a detachable manner, respectively.

According to still an aspect of still another exemplary embodiment, there is provided a light emitting device which may include at least one light emitting module including a plurality of light source groups, each including at least one light source, and a driving module configured to control turn-on and turn-off of the light source groups based on a level of power input to the driving module. Here, the driving module may be configured to turn on a different number of the light source groups as the level of the input power is changed. The at least one light emitting module may include a plurality of light emitting modules connected to one another, each including a plurality of light source groups, and, as the level of the input power is changed, the driving module may turn on the different number of the light source groups in each of the light emitting modules. Further, as the level of the input power is in a selected range, the driving module may turn on the same number of light source groups in the light emitting modules, respectively.

BRIEF DESCRIPTION OF DRAWINGS

The above and other aspects, features and advantages of the exemplary embodiments will be more clearly understood from the following detailed description taken in conjunction with the accompanying drawings, in which.

DETAILED DESCRIPTION

Figure 1:
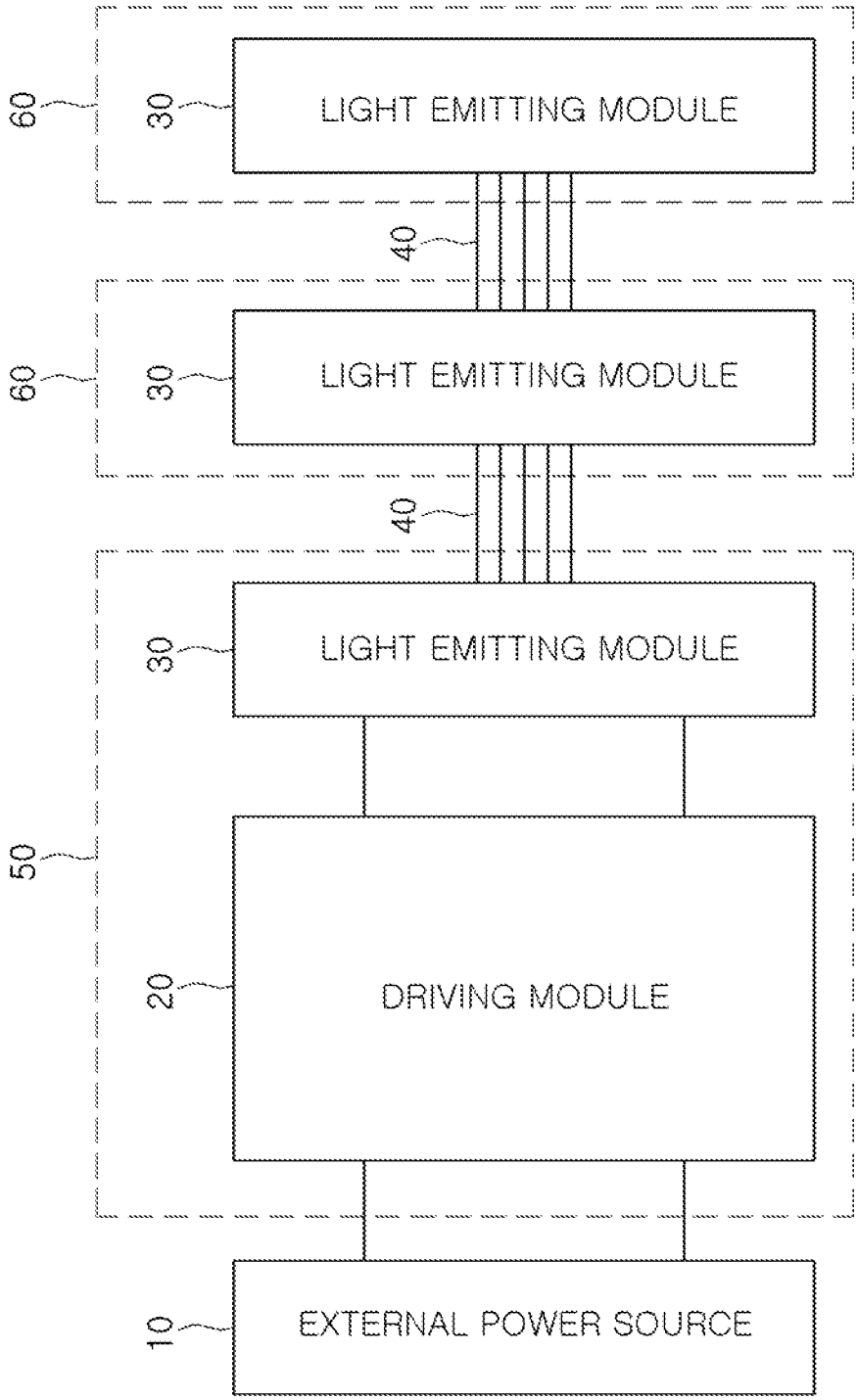
FIG. 1 is a block diagram schematically illustrating a light emitting device, according to an exemplary embodiment.

Hereinafter, exemplary embodiments of the inventive concept will be described in detail with reference to the accompanying drawings.

The inventive concept may, however, be exemplified in many different forms and should not be construed as being limited to the exemplary embodiments set forth herein. Rather, these embodiments are provided so that this disclosure will be thorough and complete, and will fully convey the scope of the inventive concept to those skilled in the art.

In the drawings, the shapes and dimensions of elements may be exaggerated for clarity, and the same reference numerals will be used throughout to designate the same or like elements.

The terminology used herein is for the purpose of describing the exemplary embodiments set forth herein only and is not intended to be limiting of the inventive concept. As used herein, the singular forms "a," "an" and "the" are intended to include the plural forms as well, unless the context clearly indicates otherwise. It will be further understood that the terms "include" "provided with" and/or "have" when used in the exemplary embodiments, specify the presence of stated features, integers, steps, operations, elements, and/or components, but do not preclude the presence or addition of one or more other features, integers, steps, operations, elements, components, and/or groups thereof. In the exemplary embodiments, terms such as "on," "lateral surface," "adjacent," "in contact with," and the like, are determined based on the drawings, and in actuality, the terms may be changed according to a direction in which a light emitting device is disposed in actuality.

FIG. 1 is a block diagram schematically illustrating a light emitting device according to an exemplary embodiment.

Referring to FIG. 1, a light emitting device according to an exemplary embodiment may include a plurality of light emitting modules 30, a driving module 20, and a module connection unit 40. The plurality of light emitting modules 30 may be physically separated from one another, and may be electrically connected to one another by the module connection units 40. As used herein, such physical separation may refer to physical separation without destroying or damaging a device. The plurality of light emitting modules 30 that are physically separated from one another may be connected to one another by the module connection units 40 in a detachable manner. The driving module 20 may be supplied with alternating current (AC) power from an external power source 10, and may supply driving power to the plurality of light emitting modules 30.

The driving module 20 and one or more of the plurality of light emitting modules 30 may be provided as a single main module 50. The remainder of the plurality of light emitting modules 30 may be provided as a sub-module 60 or sub-modules 60 physically separated from the main module 50. However, the number of light emitting modules to be provided along with the driving module in the single main module 50 and the number of the sub-modules 60 are not limited thereto. Thus, the driving module 20 and the plurality of light emitting modules 30 may be provided in a manner of being physically separated from one another as will be described in exemplary embodiments of FIGS. 9 through 11.

Figure 2A:
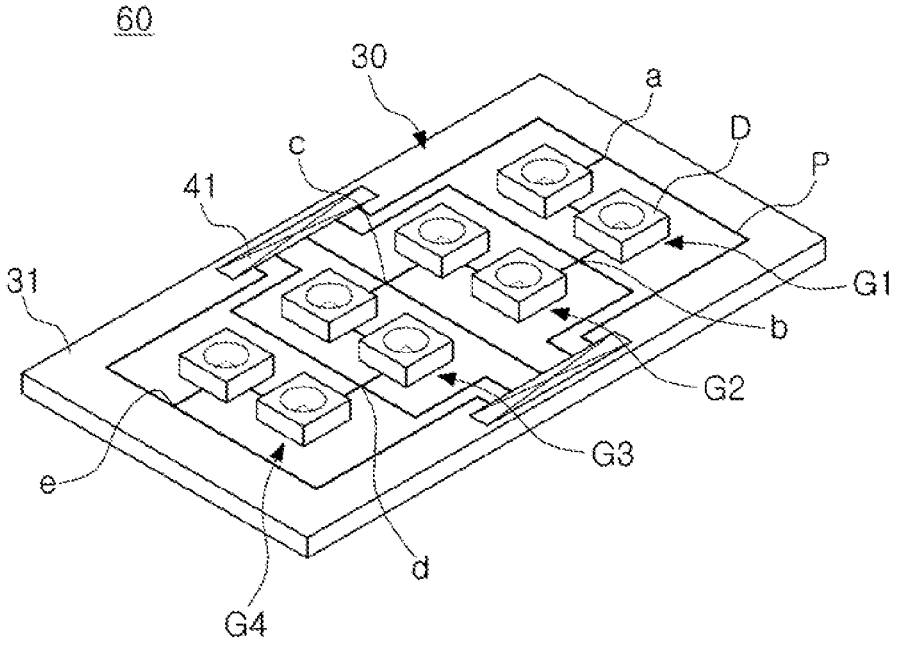
FIGS. 2A and 2B are perspective views schematically illustrating light emitting modules of a light emitting device, according to exemplary embodiments.
Figure 2B:
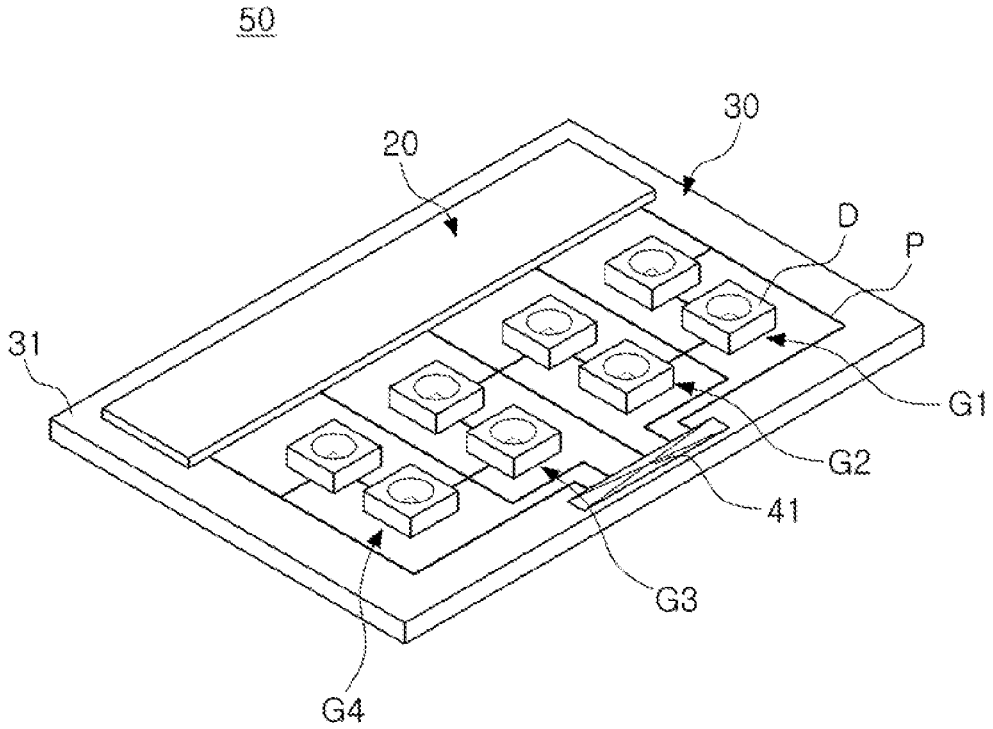

FIGS. 2A and 2B are perspective views schematically illustrating the light emitting modules 30 of a light emitting device according to exemplary embodiments.

Referring to FIG. 2A, the plurality of light emitting modules 30 may each include a circuit board 31 having a wiring pattern P, and a plurality of light source groups disposed on the circuit board 31 and electrically connected to one another by the wiring pattern P.

As illustrated in FIG. 2A, the plurality of light emitting modules 30 may each include first to fourth light source groups G1, G2, G3, and G4 electrically connected to one another by the wiring pattern P. However, the number of light source groups to be included in each of the plurality of light emitting modules is not limited thereto, and the plurality of light emitting modules may each include first to n-th light source groups, n being an integer greater than two. The first to n-th light source groups may each include at least one light emitting diode (LED) D. In the present exemplary embodiment, the light source groups G1, G2, G3, and G4 are illustrated as each including two LEDs D. The first to n-th light source groups may be connected in series in a sequence of the first to n-th light source groups.

The circuit board 31 may be provided in order to dispose a plurality of light source groups. For example, the circuit board 31 may use a printed circuit board (PCB), a metal core printed circuit board (MCPCB), or a metal printed circuit board (MPCB). Also, a flexible printed circuit board (FPCB), which is easily transformable, may be used. However, the type of circuit board is not limited thereto, and a board formed of an organic resin material containing epoxy, triazine, silicon, polyimide, and the like, and other organic resin materials, a board formed of a ceramic material such as silicon nitride (SiN), aluminum nitride (AlN), or aluminum oxide ($Al_2O_3$), or a board formed of a metal and a metal compound may also be used.

The circuit board 31 may have a surface on which the plurality of light source groups are disposed, and the surface may have a polygonal shape. For example, the circuit board 31 illustrated in FIG. 2A is illustrated as having a rectangular shape. The wiring pattern P may be formed on the surface; however, as necessary, the wiring pattern P may be formed on another surface of the circuit board 31 and/or in an interior of the circuit board 31.

As described above, the plurality of light emitting modules 30 may be physically separated from one another, and it may be interpreted as the circuit boards provided in the plurality of light emitting modules 30, respectively, being physically separated from one another.

The physically separated light emitting modules 30 may be electrically connected to one another by the module connection units 40. To this end, the module connection unit 40 may include a connector 41 disposed on the circuit board 31 provided in each of the plurality of light emitting modules 30. The connector 41 may be electrically connected to the wiring pattern P.

In the present exemplary embodiment, the module connection unit 40 may connect the first to n-th light source groups provided in each of the plurality of light emitting modules 30 to first to n-th light source groups provided in an adjacent light emitting module in parallel, respectively. In detail, the module connection unit 40 may connect first to n-th light source groups provided in one of the plurality of light emitting modules 30 and first to n-th light source groups provided in another light emitting module 30 to one another in parallel, respectively. In other words, in a case in which the plurality of light emitting modules 30 each include the first to fourth light source groups G1, G2, G3, and G4, the module connection unit 40 may connect the first light source groups G1 of the respective light emitting modules 30 to one another in parallel. In a similar manner, the second to fourth light source groups G2, G3, and G4 provided in each of the plurality of light emitting modules 30 may be connected to second to fourth light source groups G2, G3, and G4 provided in an adjacent light emitting module in parallel, respectively. To enable such a parallel connection of the light source groups, the connector 41 may be electrically connected to one nodes a, b, c, and d of respective light source groups and the other node e of the last light source group by the wiring pattern P.

The connector 41 may include a plurality of connectors to be disposed on a single circuit board 31. Accordingly, a single light emitting module 30 may be connected to a plurality of other light emitting modules 30. For example, as illustrated in FIG. 2A, a single light emitting module 30 may be connected to two separate light emitting modules 30 by two connectors 41 disposed on both edges of the circuit board 31, respectively. Although not limited hereto, the connector 41 may be disposed adjacently to one of the edges of the circuit board 31 to facilitate connections among the light emitting modules 30.

As illustrated in FIG. 2B, the driving module 20 may be disposed on a circuit board 31*a* of at least one of the light emitting modules 30. That is, one of the light emitting modules 30 may serve as the main module 50 provided with both the light emitting module 30 and the driving module 20, and the remainder of the light emitting modules 30 not provided with the driving module 20 may serve as the sub-modules 60 in a single light emitting device.

In the present embodiment, the circuit board 31*a* and the circuit board 31 provided in the main module 50 and the sub-module 60, respectively, will be referred to as a main board and a sub-board, respectively. In this case, the main board and the sub-board may be physically separated from one another, and the wiring patterns P may be formed on the main board and the sub-board, respectively. Also, a driving unit corresponding to the driving module 20, and a light source unit corresponding to the first to n-th light source groups may be disposed on the main board. Also, a light source unit corresponding to the first to n-th light source groups may be disposed on the sub-board. At least one connector 41 may be disposed on each of the main board and the sub-board.

The driving module 20 may supply driving power to the plurality of light emitting modules 30. Also, the driving module 20 may determine the number of light source groups operating in each of the plurality of light emitting modules 30 based on a level of the driving power. For example, in a case in which the plurality of light emitting modules 30 each includes four light source groups G1, G2, G3, and G4, the driving module 20 may allow only the first light source group G1 to operate in each of the plurality of light emitting modules 30 in a case in which the level of the driving power is relatively low. As the level of the driving power is increased, the driving module 20 may control the number of light source groups operating in each of the plurality of light emitting modules 30, such that the first and second light source groups G1 and G2, the first to third light source groups G1, G2, and G3, or the first to fourth light source groups G1, G2, G3, and G4 may operate in each of the plurality of light emitting modules 30.

Figure 3:
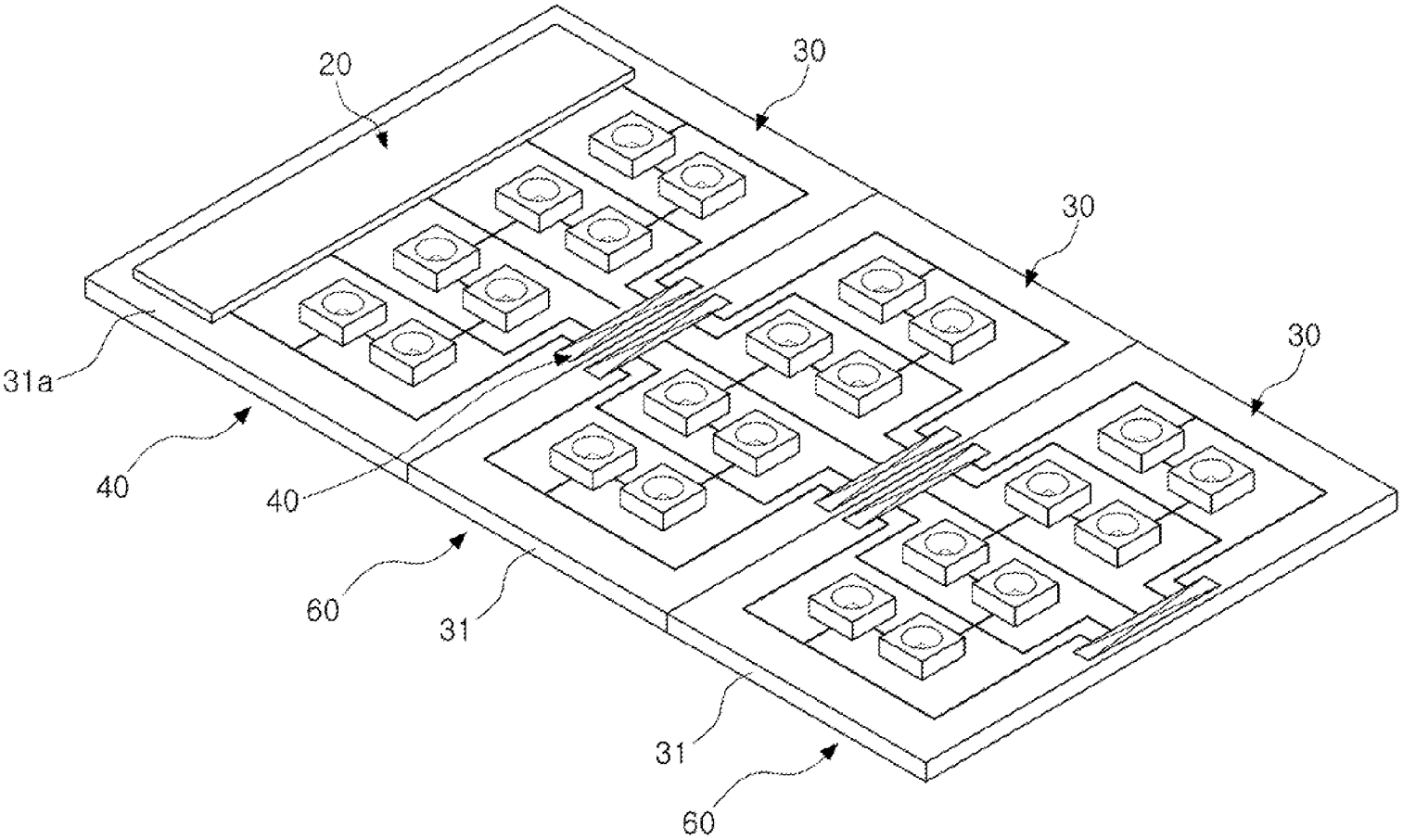
FIG. 3 is a perspective view schematically illustrating a light emitting device provided with the light emitting module, according to the exemplary embodiment of FIGS. 2A and 2B.

FIG. 3 is a perspective view schematically illustrating a light emitting device provided with the light emitting module according to the exemplary embodiment of FIGS. 2A and 2B. FIGS. 4 and 5A-5C are a circuit diagram and a voltage waveform graph, respectively, illustrating an operation of the light emitting device illustrated in FIG. 3. FIGS. 6A through 6D are circuit diagrams of a current path illustrating an operation of the light emitting device illustrated in FIG. 3.

Referring to FIG. 3, in the light emitting device according to the present exemplary embodiment, the light emitting module 30 having the driving module 20 disposed on the circuit board 31*a* thereof, for example, the main module 50 with reference to FIG. 2B, and the two light emitting modules 30 not having the driving module 20 disposed on the circuit board 31 thereof, for example, the two sub-modules 60 with reference to FIG. 2A, may be electrically connected to one another by the module connection unit 40.

Hereinafter, the operation of the light emitting device illustrated in FIG. 3 will be described in greater detail with reference to FIGS. 4, 5A-5C and 6A-6D.

Figure 4:
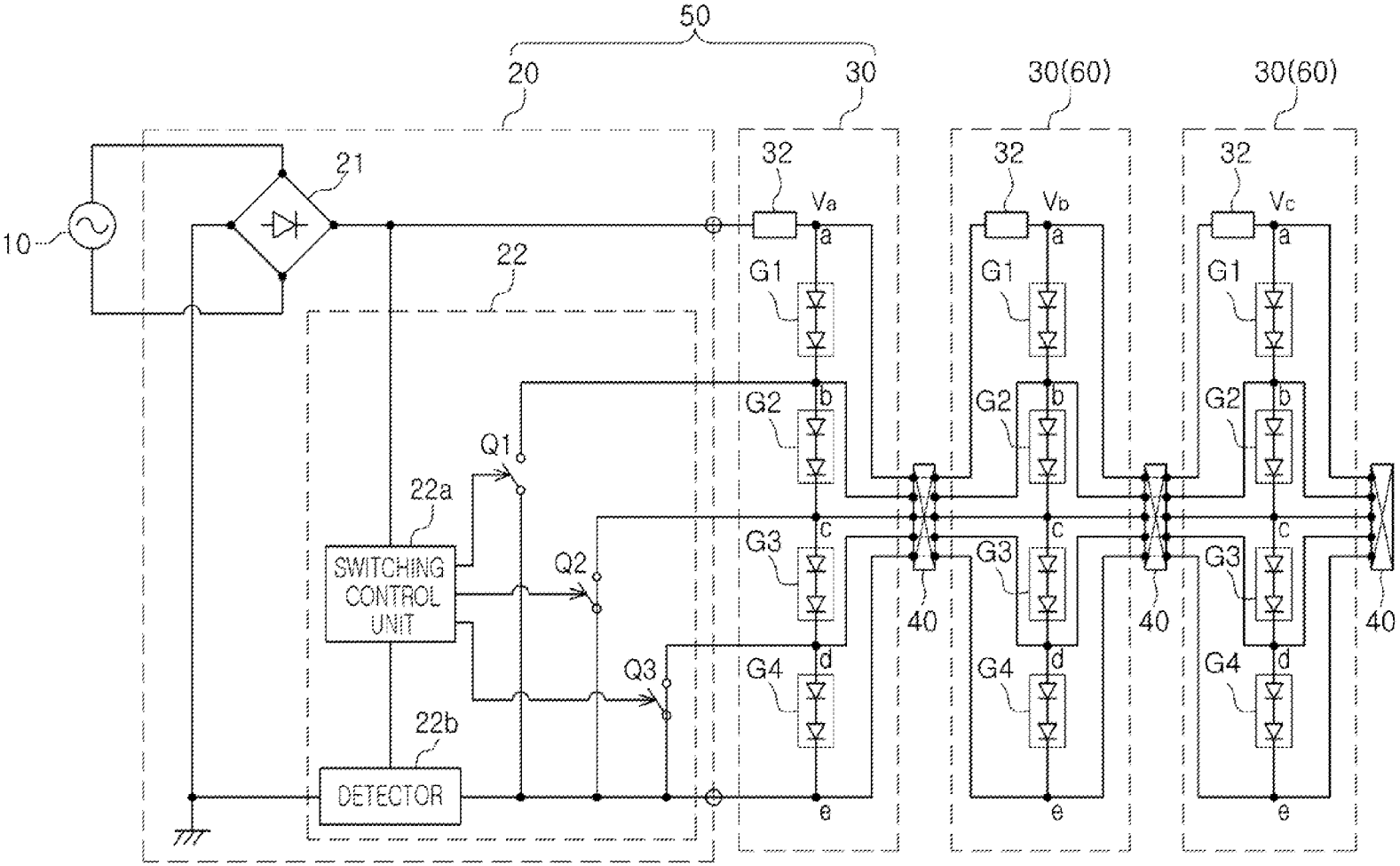
FIG. 4 is a circuit diagram illustrating an operation of the light emitting device illustrated in FIG. 3, according to an exemplary embodiment.
Figure 5A:
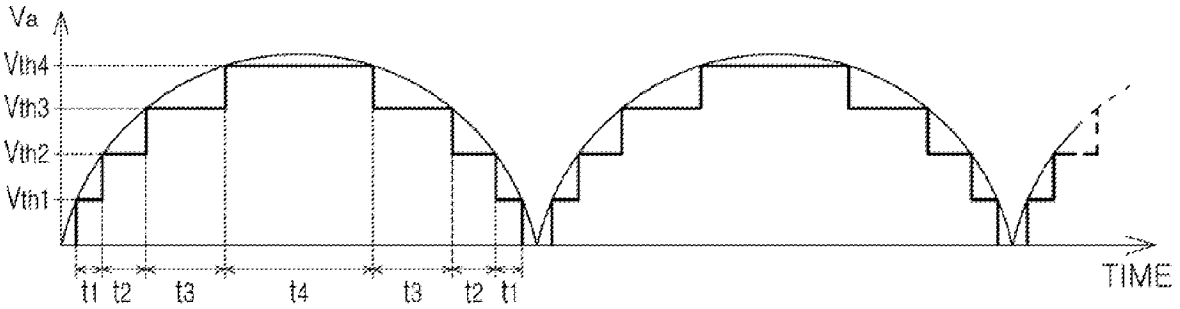
FIGS. 5A through 5C are voltage waveform graphs illustrating operations of the light emitting device illustrated in FIG. 3, according to an exemplary embodiment.
Figure 5B:
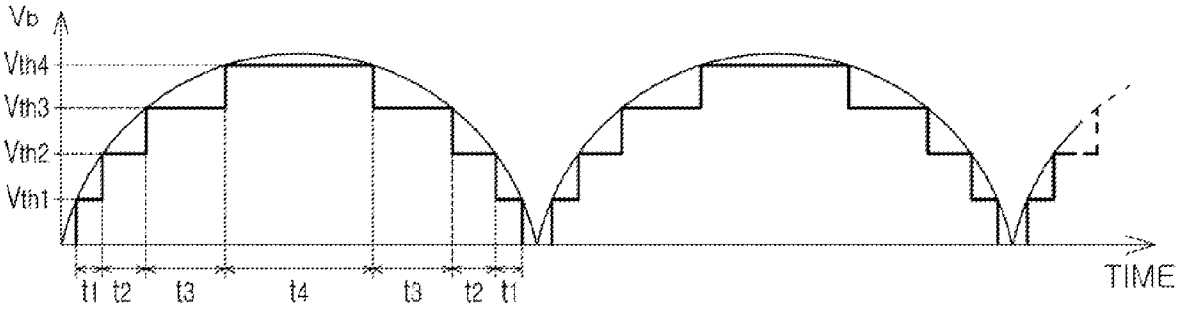
Figure 5C:
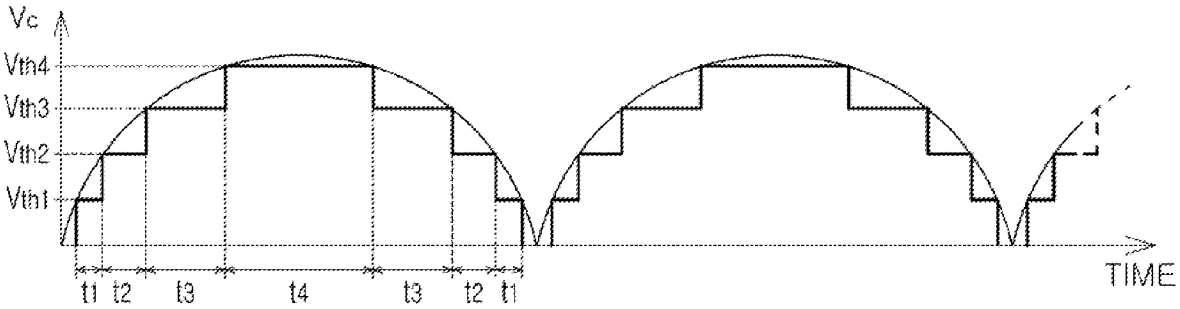

Referring to FIG. 4, the driving module 20 may be supplied with an AC power from the external power source 10. In this case, the driving module 20 may include a rectifier configured to rectify the AC power. Although the rectifier 21 is illustrated as a bridge diode full-wave rectifying AC power, the type of rectifier 21 is not limited thereto. Power rectified in the rectifier 21 may be supplied to the plurality of light emitting modules 30 to serve as driving power for driving a light source group. Here, the driving power may be DC power in a form of a sine wave as illustrated in FIGS. 5A-5C.

The driving module 20 may determine the number of light source groups operating in each of the plurality of light emitting modules 30 based on a level of the driving power. To this end, the driving module 20 may include a controller 22 configured to control a path of currents applied to the plurality of light emitting modules 30 and flow into a ground based on the level of the driving power. In detail, the controller 22 may change a path of currents passing through at least one of the first to n-th light source groups provided in the plurality of light emitting modules 30 and flowing into the ground, based on the level of the driving power varying in predetermined periods of time.

Although not limited hereto, the controller 22 may include a plurality of switches Q1, Q2, and Q3 forming connections between the ground and each of the nodes b, c, and d of respective light source groups, and a switching controller 22*a* controlling switching operations of the plurality of switches Q1, Q2, and Q3. Although not limited hereto, the plurality of switches Q1, Q2, and Q3 may use, for example, a transistor device, and the switching controller 22*a* may include a comparator. The comparator may include an operational amplifier (OP Amp).

The controller 22 may further include a detector 22*b* detecting the level of the driving power. The detector 22*b* may include, for example, a resistor device, and may be inserted into an appropriate position in the controller 22 to detect a level of currents applied to the plurality of light emitting modules 30.

Hereinafter, the operation of the light emitting device based on the level of the driving power will be described in greater detail with reference to FIGS. 5A-5C and 6A-6D.

Figure 6A:
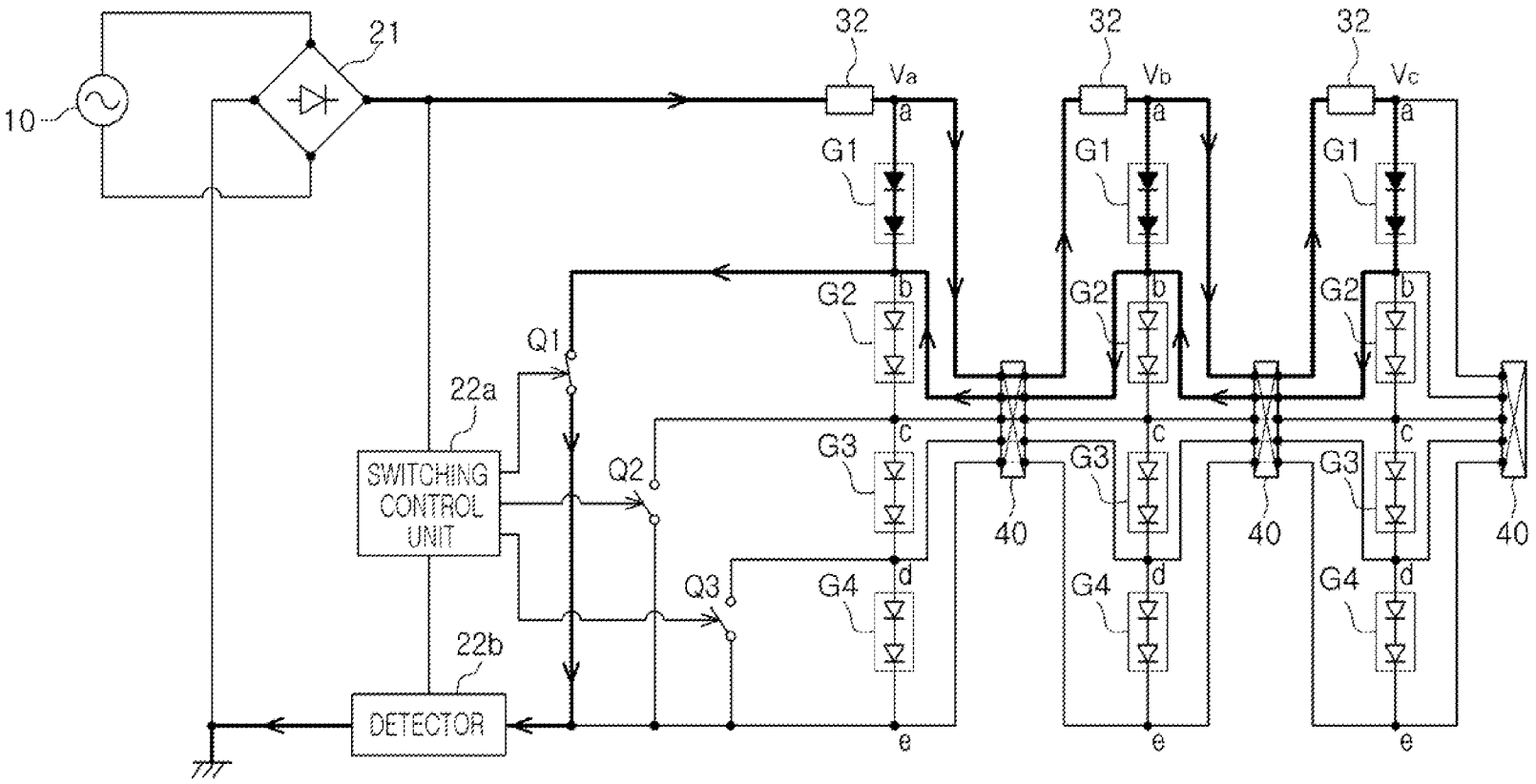
FIGS. 6A through 6D are circuit diagrams of a current path illustrating an operation of the light emitting device illustrated in FIG. 3, according to an exemplary embodiment.

The voltage waveform graphs in FIGS. 5A-5C illustrate voltages Va, Vb, and Vc in one nodes a of the first light source groups of the three light emitting modules 30 illustrated in FIG. 4, respectively. Referring to FIGS. 5A-5C, a voltage level of the driving power may vary in predetermined periods of time, and based on threshold voltage characteristics of the LED D (see FIGS. 2A-2B), in a case in which the voltage level of the driving power is higher than a level of a minimum voltage Vth1 capable of driving the first light source group G1 and is lower than a level of a minimum voltage Vth2 capable of driving the first and second light source groups G1 and G2, that is, in a case in which the driving power is in a first driving interval t1, the control unit 22 may turn on the first switch Q1 connected to the node b between the first light source group G1 and the second light source group G2 as illustrated in FIG. 6A, and may control currents applied to each of the plurality of light emitting modules 30 to pass through the first light source group G1 and flow into the ground. In this case, only the first light source group G1 may operate in each of the light emitting modules 30.

Figure 6B:
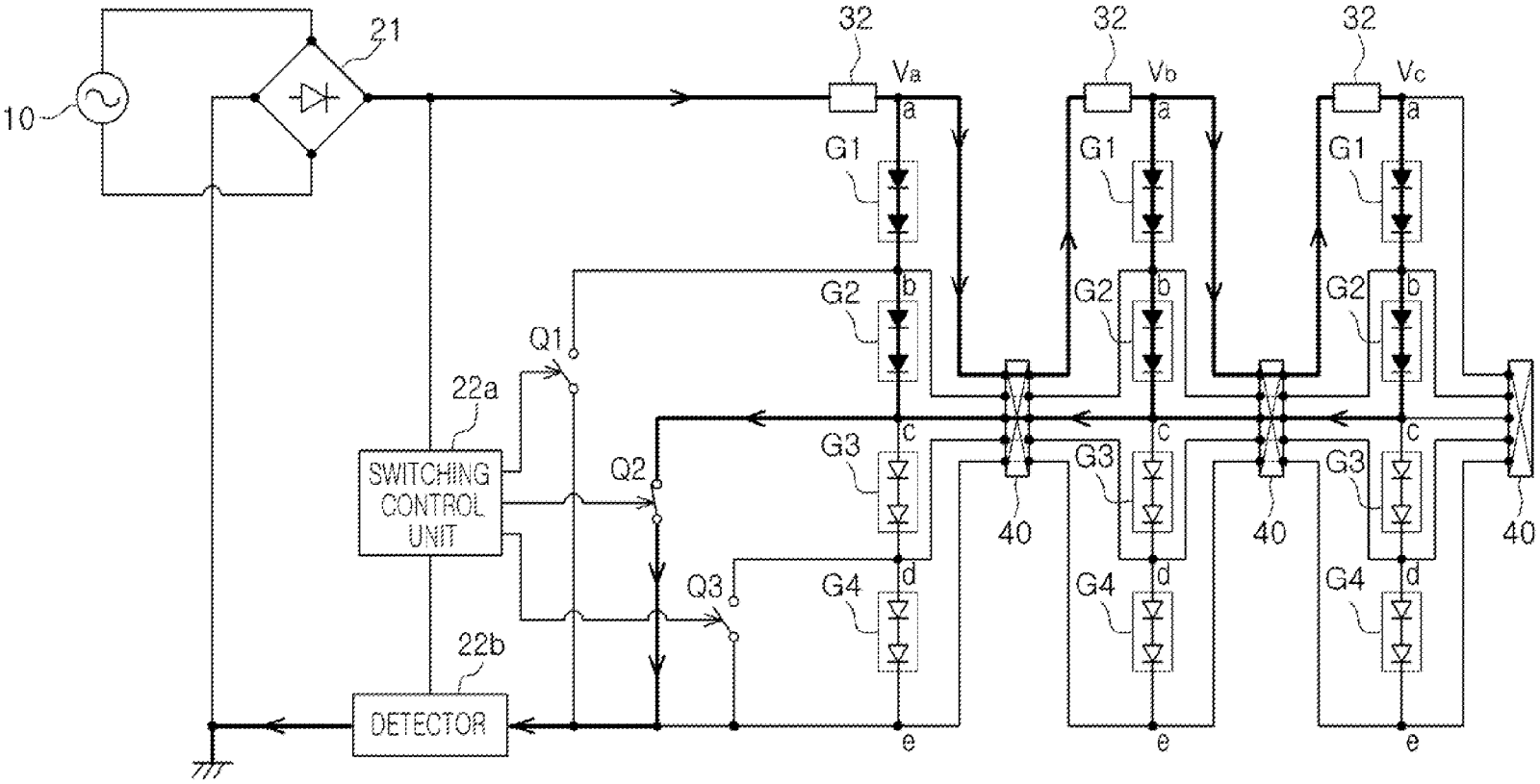

In a case in which the level of the driving power is higher than the level of the minimum voltage Vth2 capable of driving the first and second light source groups G1 and G2 and is lower than a level of a minimum voltage Vth3 capable of driving the first to third light source groups G1 to G3, that is, in a case in which the driving power is in a second driving interval t2, the control unit 22 may turn off the first switch Q1, may turn on the second switch Q2 connected to the node c between the second light source group G2 and the third light source group G3 as illustrated in FIG. 6B, and may control the currents applied to each of the plurality of light emitting modules 30 to pass through the first and second light source groups G1 and G2 and flow into the ground. In this case, only the first and second light source groups G1 and G2 may operate in each of the light emitting modules 30.

Figure 6C:
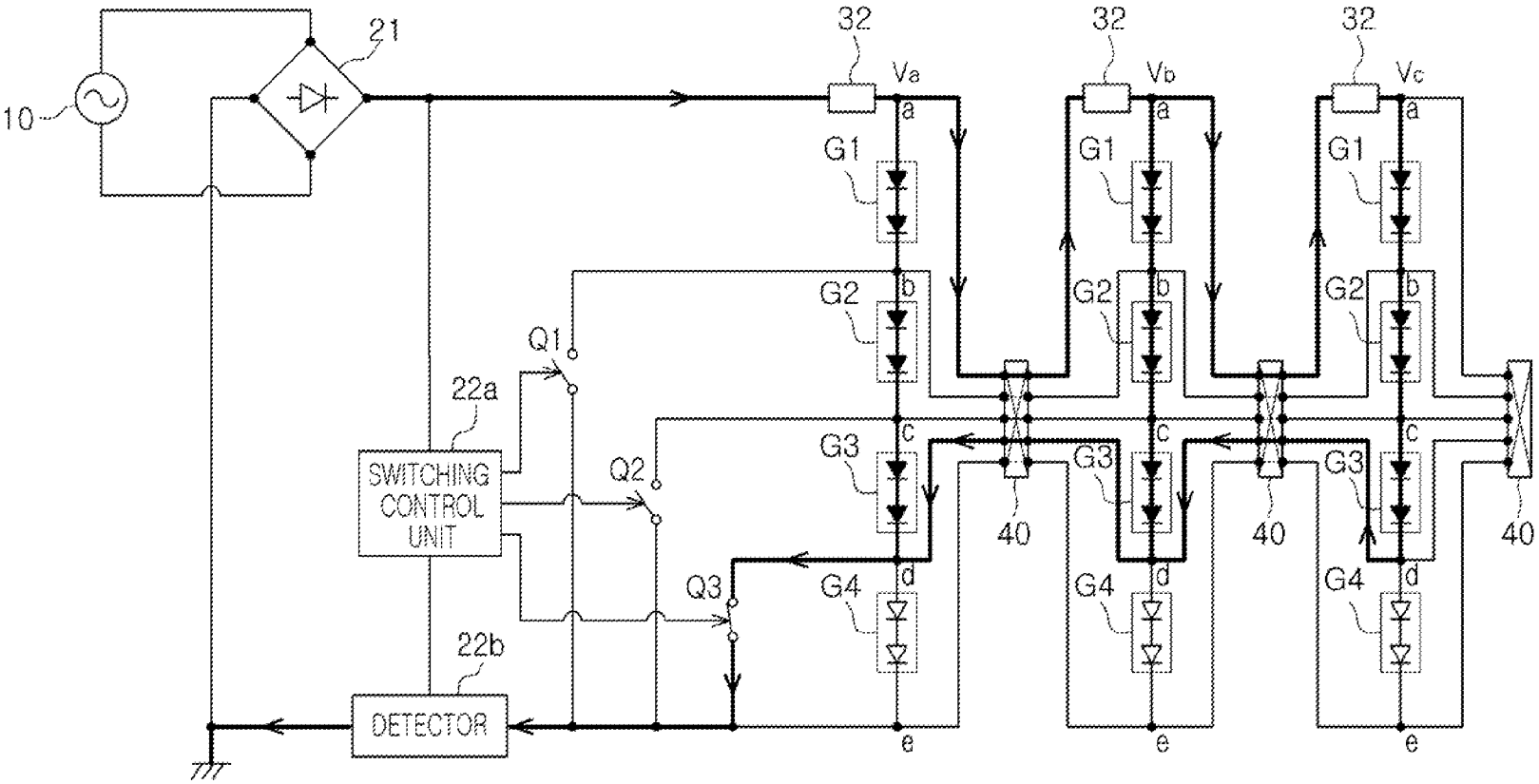

In a case in which the level of the driving power is higher than the level of the minimum voltage Vth3 capable of drive driving the first to third light source groups G1, G2, and G3 and is lower than a level of a minimum voltage Vth4 capable of drive driving the first to fourth light source groups G1, G2, G3, and G4, that is, in a case in which the driving power is in a third driving interval t3, the control unit 22 may turn off the first and second switches Q1 and Q2, may turn on the third switch Q3 connected to the node d between the third light source group G3 and the fourth light source group G4 as illustrated in FIG. 6C, and may control the currents applied to each of the plurality of light emitting modules 30 to pass through the first to third light source groups G1, G2, and G3 and flow into the ground. In this case, only the first to third light source groups G1, G2, and G3 may operate in each of the light emitting modules 30.

Figure 6D:
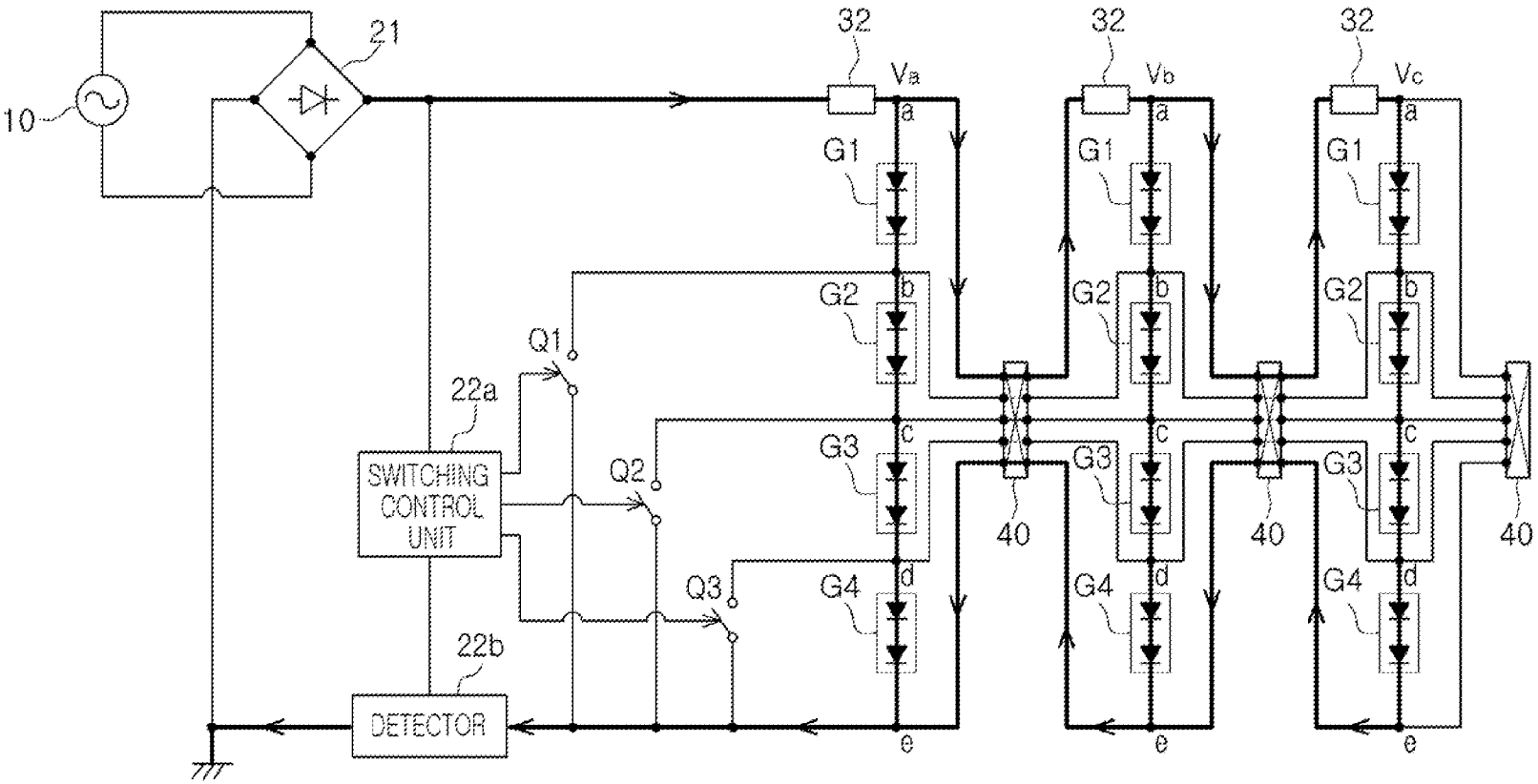

In a case in which the level of the driving power is higher than a level of a minimum voltage Vth4 capable of drive driving the first to fourth light source groups G1, G2, G3, and G4, that is, in a case in which the driving power is in a fourth driving interval t4, the control unit 22 may control the currents applied to each of the plurality of light emitting modules 30 to pass through all of the first to fourth light source groups G1, G2, G3, and G4 and flow into the ground. In this case, as illustrated in FIG. 6D, all of the first to third switches Q1, Q2, and Q3 may be turned off, and the first to fourth light source groups G1, G2, G3, and G4 may operate in each of the light emitting modules 30.

In FIG. 4, the nodes a-e of one light emitting module are connected to the nodes a-e of the other light emitting modules, respectively. However, the inventive concept is not being limited to this configuration a light emitting device. According to another exemplary embodiment, the node a of one light emitting module may be connected to the node b of another light emitting module which is connected to the node c of another light emitting module through the module connection unit.

Since the light emitting device according to the present exemplary embodiment is provided with a plurality of light emitting modules rather than a single light emitting module, a plurality of light emitting modules, for example, three light emitting modules may operate in each driving interval of the driving power, for example, first to fourth driving intervals. In this case, luminous flux output from the light emitting device may be increased in proportion to the number of light emitting modules 30 being provided. Although not limited hereto, the luminous flux of the light emitting device may be increased in direct proportion to the number of light emitting modules 30.

According to the present exemplary embodiment, since the light emitting modules 30 are connected to one another by the module connection unit 40 in a detachable manner, an additional light emitting module 30 may be included in a light emitting device as necessary. In this case, a light emitting device in an AC direct driving scheme capable of readily changing output luminous flux may be achieved.

In the exemplary embodiment, the light emitting module 30 may further include a resistor unit 32 connected to the first to n-th light source groups in series, as necessary as illustrated in FIG. 4. The resistor unit 32 may adjust an amount of currents flowing in each of the plurality of light emitting modules 30 by changing impedance of the light emitting device. In other words, luminous flux of light emitted from each of the plurality of light emitting modules 30 may be adjusted. The resistor unit 32 may be a resistor device having a fixed resistance level; however, the type of resistor unit is not limited thereto, and may include a variable resistor.

Figure 7:
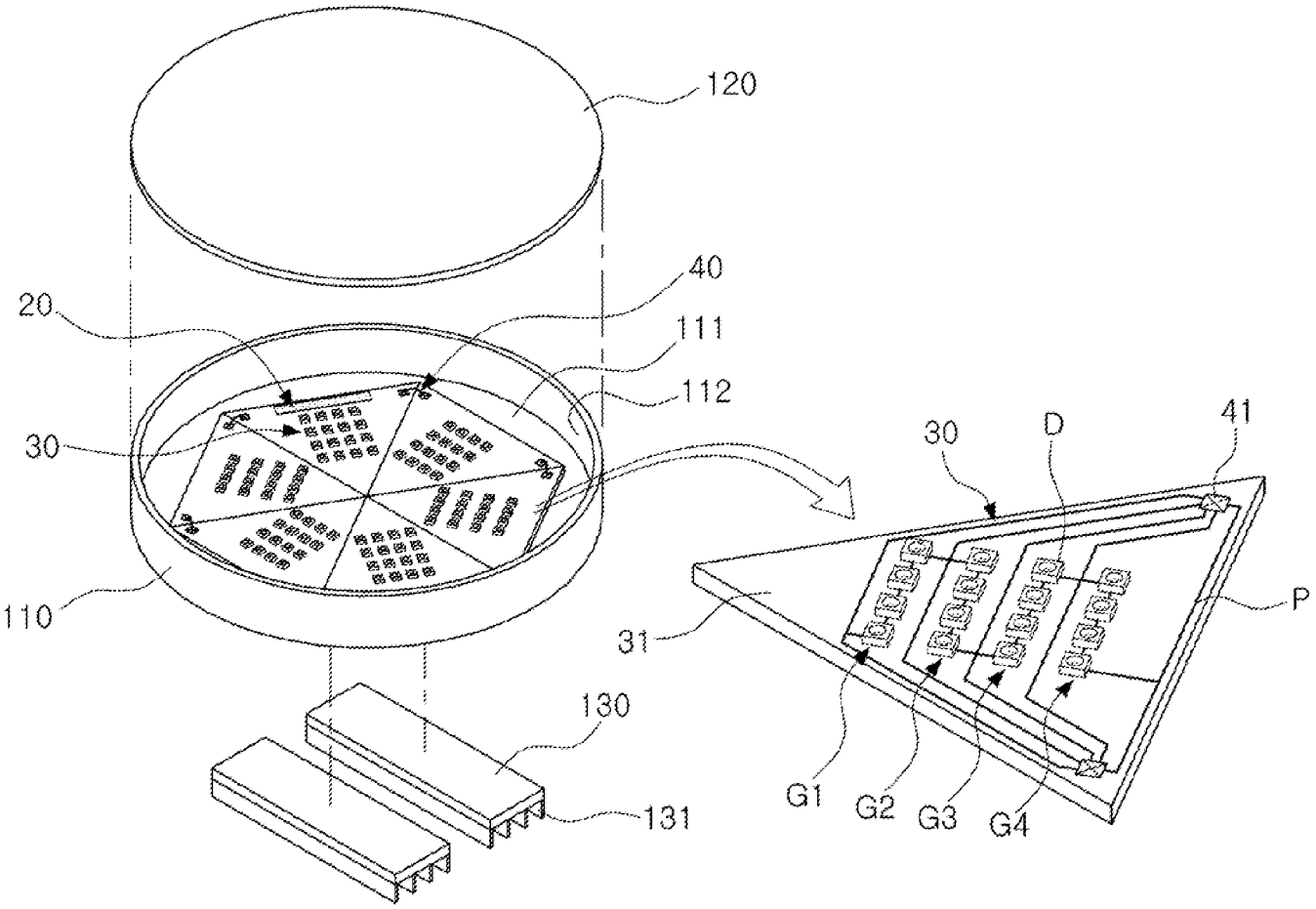
FIGS. 7 and 8 are exploded perspective views schematically illustrating a light emitting device, according to exemplary embodiments.

FIG. 7 is an exploded perspective view schematically illustrating a light emitting device according to an exemplary embodiment.

Referring to FIG. 7, in the present exemplary embodiment, the light emitting device may include a driving module 20, a plurality of light emitting modules 30, and a module connection unit 40. Hereinafter, descriptions of elements the same as those provided above will be omitted, and different configurations will mainly be described.

The plurality of light emitting modules 30 may include a circuit board 31 and a plurality of light source groups disposed on the circuit board 31. In the present exemplary embodiment, the plurality of light emitting modules 30 may each include first to fourth light source groups G1, G2, G3, and G4, and each light source group may be illustrated as including four LEDs D connected to one another in series by a wiring pattern P. The driving module 20 may be disposed on the circuit board of one of the plurality of light emitting modules 30.

The plurality of light emitting modules 30 may be connected to one another by the module connection unit 40. The module connection unit 40 may include a connector 41 disposed on the circuit board 31 provided in each of the plurality of light emitting modules 30. Although not limited hereto, the connector 41 may include a plurality of connectors to be disposed on the circuit board 31.

In the present exemplary embodiment, the circuit board 31 provided in each of the plurality of light emitting modules 30 may have a surface on which the light source groups are disposed, and the surface of each of the plurality of light emitting modules 30 may have a polygonal shape. Although not limited hereto, the surface of each of the plurality of light emitting modules 30 may have a regular polygonal shape. For example, as illustrated in FIG. 7, the surface of each of the plurality of light emitting modules 30 may have an equilateral triangular shape. The circuit boards 31 provided in the plurality of light emitting modules 30, respectively, may have substantially different shapes and sizes from one another. Each circuit board 31 may be disposed in a manner that lateral surfaces thereof are in contact with those of other adjacent circuit boards 31, and thereby mounting density of the plurality of light emitting modules 30 may be increased, and relatively uniform light emitting distribution may be achieved.

In the present exemplary embodiment, the light emitting device may include a housing 110 in which the plurality of light emitting modules 30 are mounted, and a cover unit 120 through which light emitted from the plurality of light emitting modules 30 is dissipated externally.

The housing 110 may have a box-type structure including a surface 111 on which the plurality of light emitting modules 30 are disposed, and a lateral surface 112 extending from a circumference of the surface 111. The housing 110 may be formed of a material, for example, a metal, having relatively high thermal conductivity in order to externally dissipate heat generated in the plurality of light emitting modules 30, the driving module 20, and the like. For relatively enhanced heat radiating efficiency, a heat sink 130 may be attached to the housing 110. The heat sink 130 may be provided with a plurality of heat dissipation fins 131.

The cover unit 120 may be mounted on the housing 110, and may be formed of a light transmissive material. The cover unit 120 may contain a light diffusive material to allow light emitted from the plurality of light emitting modules 30 to be dissipated externally in a uniform manner. Also, the cover unit 120 may have a convex lens shape, a concave lens shape, or the like, for optical effects.

Figure 8:
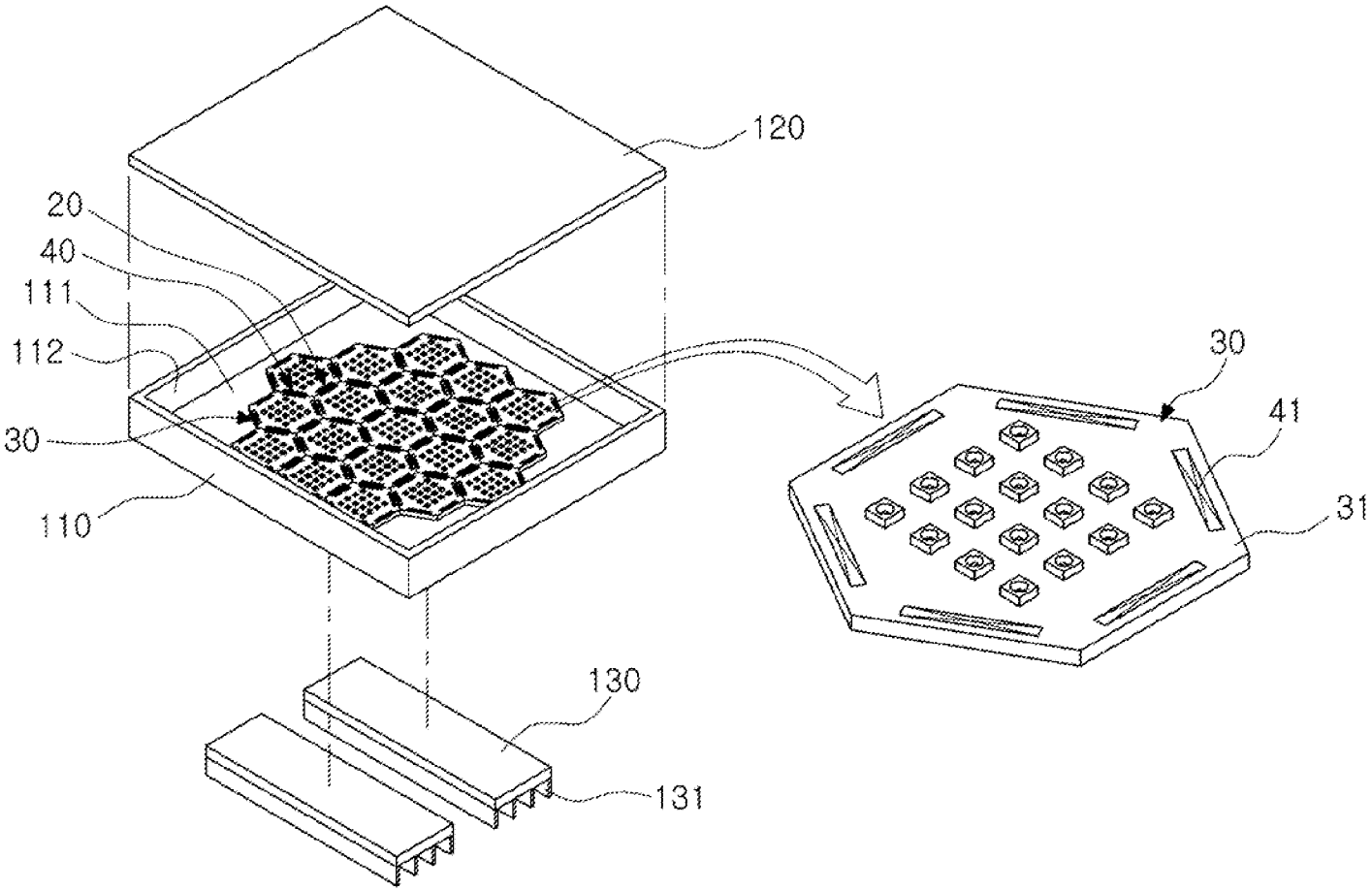

FIG. 8 is an exploded perspective view schematically illustrating a light emitting device according to an exemplary embodiment. Hereinafter, descriptions of elements the same as those provided in FIG. 7 will be omitted, and different configurations will mainly be described. In FIG. 8, an illustration of a wiring pattern provided in each circuit board 31 is omitted.

In the present exemplary embodiment, the circuit board 31 provided in each of a plurality of light emitting modules 30 may have a surface on which light source groups are disposed, and the surface of each of the plurality of light emitting modules 30 may have a regular hexagonal shape. Each circuit board 31 may be disposed in a manner that lateral surfaces thereof are in contact with those of other adjacent circuit boards 31. Accordingly, the circuit boards 31 may be arranged in a honeycomb structure. In this case, mounting density of the plurality of light emitting modules 30 may be increased, and relatively uniform light emitting distribution may be achieved.

A plurality of connectors 41 may be disposed on each circuit board 31. The connectors 41 may be disposed on edges of the surface of the circuit board 31, respectively. However, the number of connectors 41 to be disposed on the circuit board 31 is not limited thereto, and may be adjusted in various manners as necessary.

Figure 9:
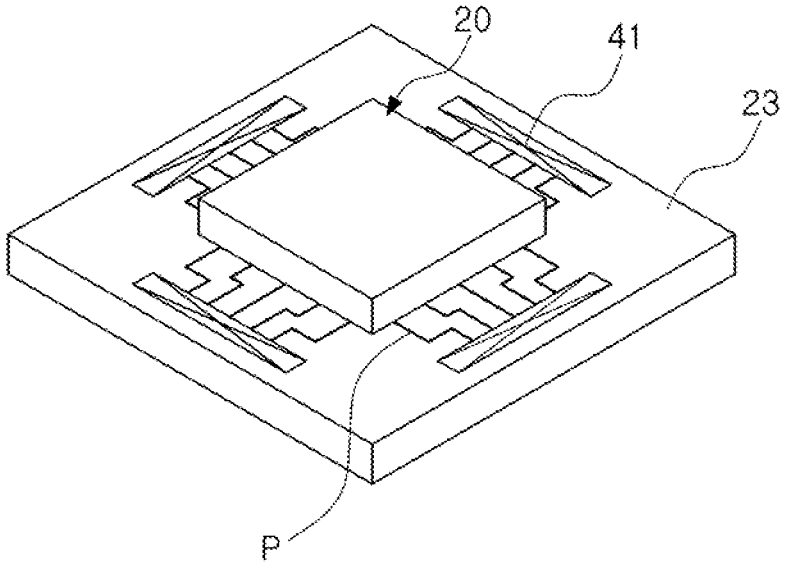
FIG. 9 is a perspective view schematically illustrating a driving module of a light emitting device, according to an exemplary embodiment.
Figure 10:
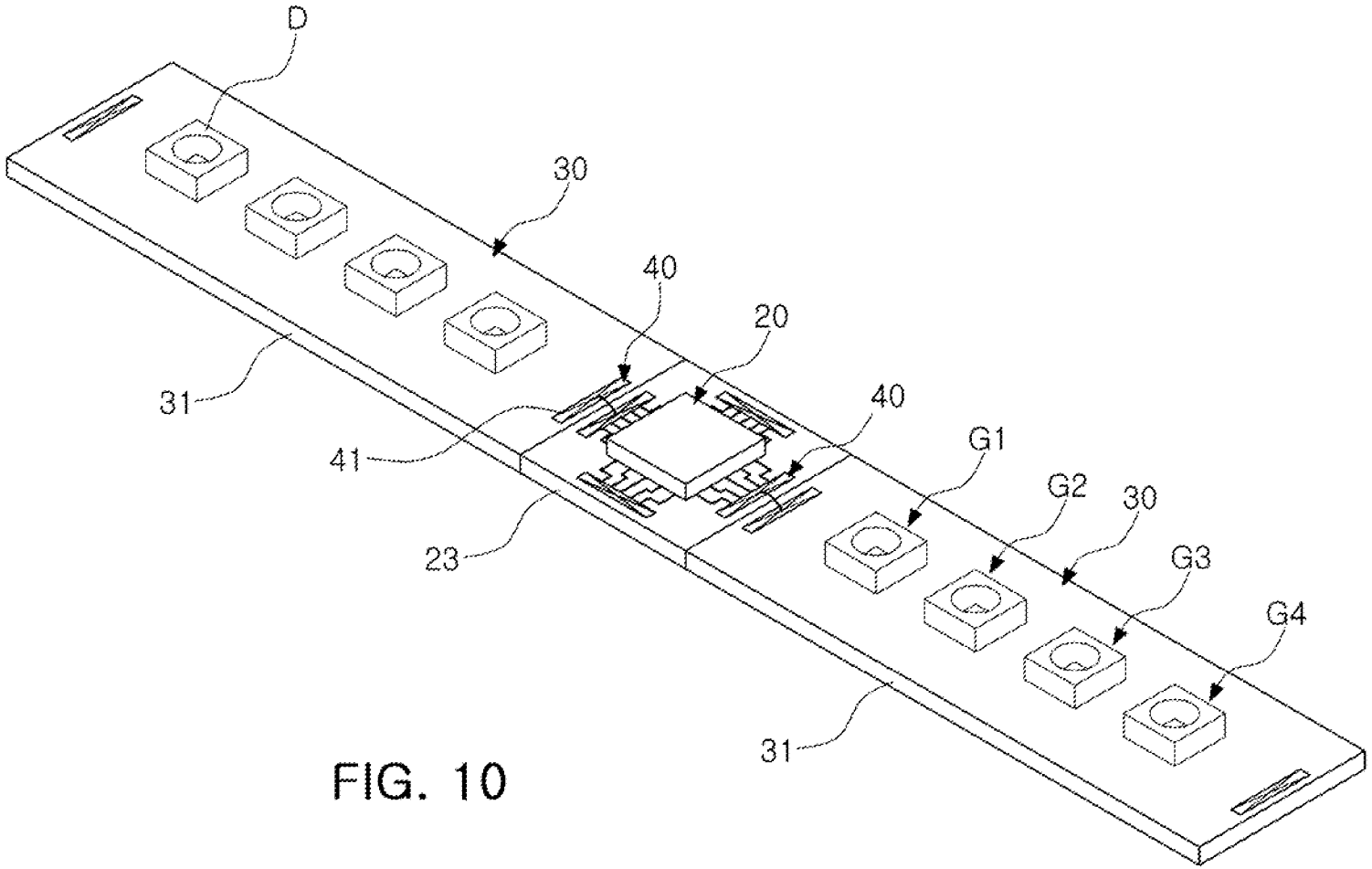
FIG. 10 is a perspective view schematically illustrating a light emitting device in a state in which a plurality of light emitting modules are mounted on the driving module according to the exemplary embodiment of FIG. 9.
Figure 11:
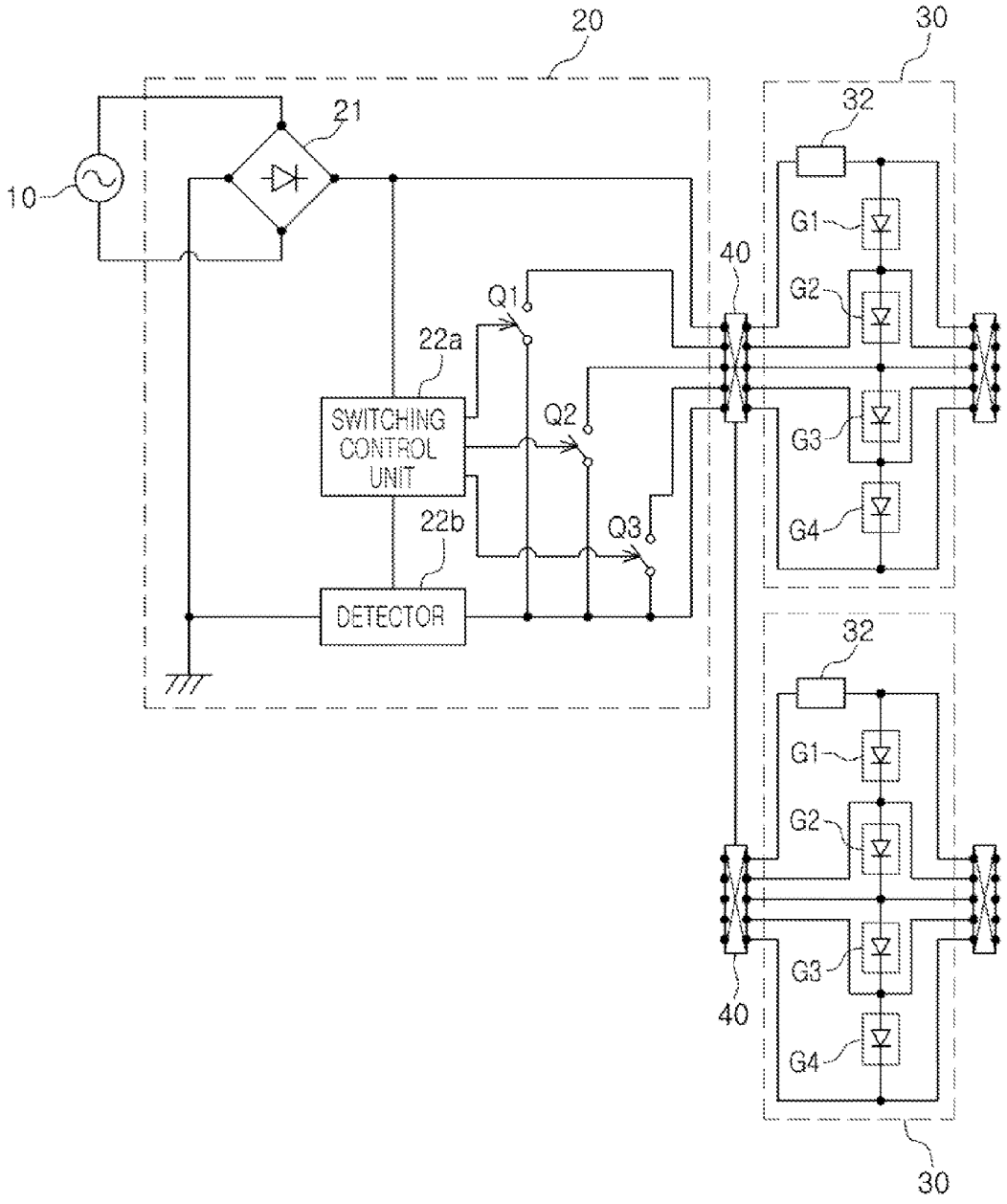
FIG. 11 is a circuit diagram illustrating an operation of the light emitting device illustrated in FIG. 10, according to an exemplary embodiment.

FIGS. 9 through 11 are views illustrating a light emitting device according to exemplary embodiments.

FIG. 9 is a perspective view schematically illustrating a driving module 20 of a light emitting device according to an exemplary embodiment. FIG. 10 is a perspective view schematically illustrating a light emitting device in a state in which a plurality of light emitting modules 30 are mounted on the driving module 20 according to the exemplary embodiment of FIG. 9. FIG. 11 is a circuit diagram illustrating an operation of the light emitting device illustrated in FIG. 10.

Referring to FIGS. 9 and 10, the driving module 20 according to the present exemplary embodiment may be disposed on a circuit board including a wiring pattern P. The circuit board may not include a light source group disposed thereon. Hereinafter, the circuit board including the driving module 20 disposed thereon while not including the light source group disposed thereon will be referred to as a driving module board 23.

The driving module board 23 may be physically separated from the circuit board 31 provided in each of the plurality of light emitting modules 30. The driving module 20 and the light emitting module 30 may be electrically connected to one another by module connection units 40 in a detachable manner.

The module connection units 40 may include connectors 41, respectively, disposed on the driving module board 23 and the circuit board 31 provided in the light emitting module 30 for an electrical connection between the driving module 20 and the light emitting module 30.

The plurality of light emitting modules 30 illustrated in FIG. 10 may include the circuit board 31 and a plurality of light source groups disposed on the circuit board 31. FIG. 10 illustrates that the plurality of light source groups may include first to fourth light source groups G1, G2, G3, and G4, and each light source group may include a single LED D; however, the number of light source groups to be included in the light emitting module and the number of LEDs to be included in the light source group are not limited thereto. In FIG. 10, illustration of a wiring pattern is omitted.

Referring to FIG. 11, the driving module 20 may determine the number of light source groups operating in each of the plurality of light emitting modules 30 based on a level of driving power. For example, in a case in which the level of the driving power is relatively low, the driving module 20 may enable only the first light source group G1 to operate, and in a case in which the level of the driving power is relatively high, the driving module 20 may set the number of operating light source groups to be increased.

Luminous flux output from the light emitting device may be changed based on the number of the light emitting modules 30. In the present exemplary embodiment, since the light emitting module 30 may be connected to the driving module 20 and to the other light emitting modules 30 by the module connection units 40 in a detachable manner, the number of the light emitting modules 30 to be included in the light emitting device may be readily changed. Accordingly, maximum luminous flux output from the light emitting device may also be readily changed.

Figure 12:
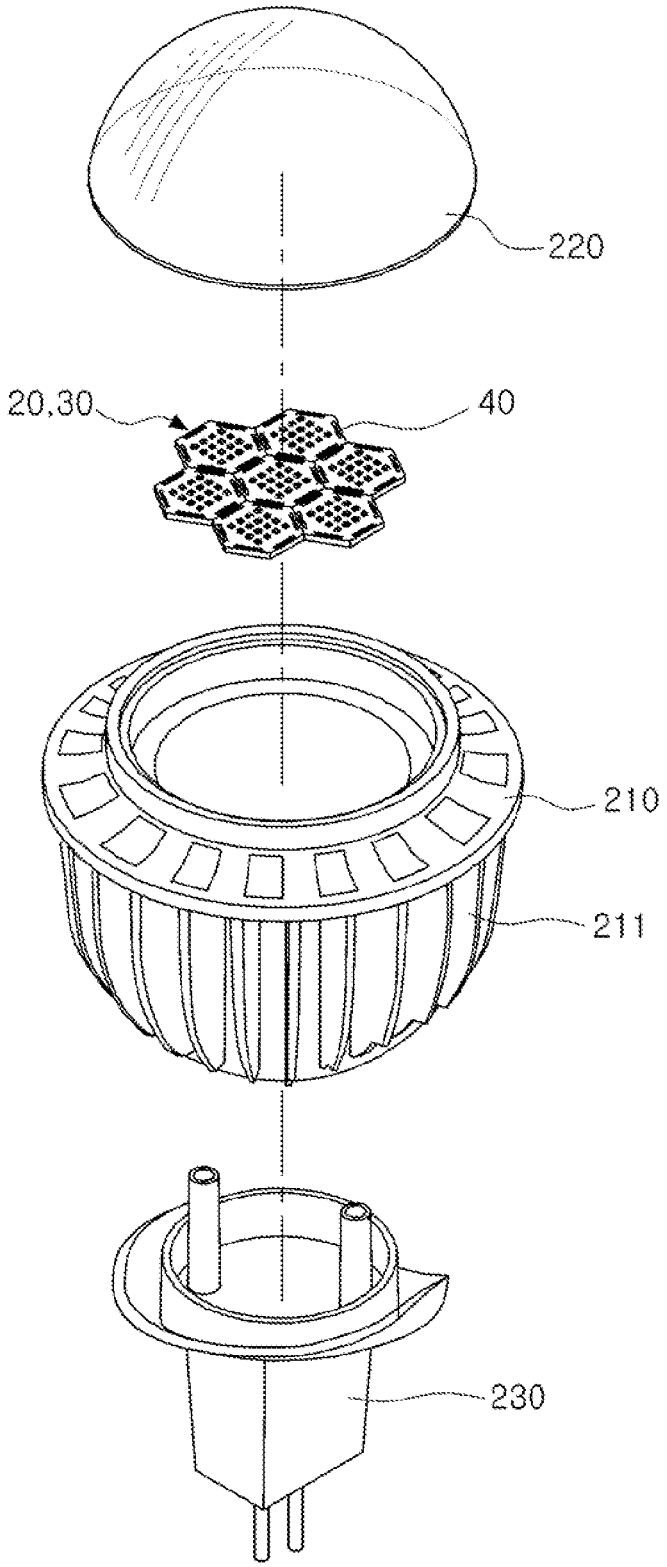
FIGS. 12 and 13 are exploded perspective views schematically illustrating light emitting devices, according to exemplary embodiments.

FIG. 12 is an exploded perspective view schematically illustrating a light emitting device according to an exemplary embodiment. As illustrated in FIG. 12, the light emitting device may be applied to a bulb-type lamp.

In the present exemplary embodiment, the light emitting device may include a housing 210, and a plurality of light emitting modules 30, a driving module 20, and a module connection unit 40 to be installed in the housing 210. The driving module 20 may be disposed on a circuit board provided in one of the plurality of light emitting modules 30. However, the type of board on which the driving module 20 is to be disposed is not limited thereto, and the driving module 20 may be disposed on a separate driving module board and may be electrically connected to the plurality of light emitting modules 30 by the module connection units 40. The plurality of light emitting modules 30 may be combined with one another by the module connection units 40 in a detachable manner.

The housing 210 may serve as a frame supporting the plurality of light emitting modules 30, and as a heat sink externally dissipating heat generated in the light emitting modules 30. To this end, the housing 210 may be formed of a rigid material having relatively high thermal conductivity. For example, the housing 210 may be formed of a metal material such as aluminum (Al), or a heat radiating resin. An outer lateral surface of the housing 210 may include a plurality of heat dissipation fins 211 for significantly enhancing heat radiating efficiency by increasing a contact area thereof with air. The light emitting device may include a terminal unit 230 transferring externally supplied power to the driving module 20.

A cover unit 220 disposed on the housing 210 may encapsulate the light emitting module, and may have a convex lens shape or a bulb shape. The cover unit 220 may be formed of a light transmissive material, and may contain a light diffusive material.

Figure 13:
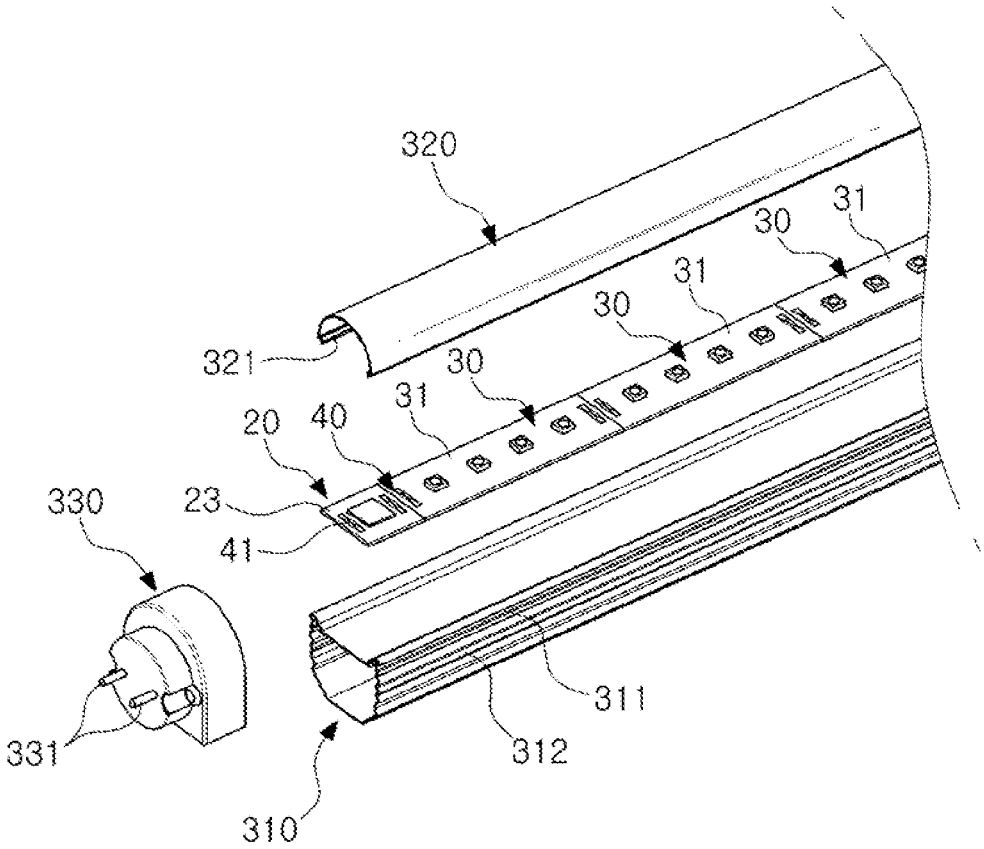

FIG. 13 is an exploded perspective view schematically illustrating a light emitting device according to an exemplary embodiment. As illustrated in FIG. 13, the light emitting device may be applied to a bar-type lamp.

In the present exemplary embodiment, the light emitting device may include a housing 310, and a plurality of light emitting modules 30, a driving module 20, and a module connection unit 40 to be installed in the housing 310. The driving module 20 may be disposed on a separate driving module board 23 physically separated from the circuit board 31 provided in each of the plurality of light emitting modules 30. The module connection unit 40 may electrically connect the driving module 20 and the plurality of light emitting modules 30 to one another. The module connection unit 40 may include the connector 41 disposed on both of the driving module board 23 and the circuit board 31 provided in each of the plurality of light emitting modules 30. The plurality of light emitting modules 30 and the driving module 20 may be combined with one another by the module connection units 40 in a detachable manner.

The housing 310 may have a shape extending in a direction thereof, and may be formed of a material having relatively high thermal conductivity. A plurality of heat dissipation fins 312 used for dissipating heat may be provided on both lateral surfaces of the housing 310 while protruding therefrom.

The housing 310 may include a cover unit 320 disposed thereon. The cover unit 320 may be fastened to a fastening groove 311 of the housing 310 so as to encapsulate the light emitting module 30. A protrusion portion 321 engaged with the fastening groove 311 of the housing 310 may be formed on a bottom surface of the cover unit 320 in a lengthwise direction of the housing 310. The cover unit 320 may have a semicircular curved surface to allow light generated in the light emitting module 30 to be dissipated externally in a uniform manner.

A terminal unit 330 may be provided in an open end portion of the housing 310 in the lengthwise direction thereof, and may supply external power to the driving module 20. The terminal unit 330 may include an outwardly protruding electrode pin 331.

According to the present exemplary embodiment, luminous flux output from the light emitting device may be readily changed by simply changing the number of light emitting modules to be provided in the light emitting device.

As set forth above, according to exemplary embodiments in the present disclosure, the light emitting device capable of driving without using a constant current circuit may be achieved. Also, in such a light emitting device using an AC direct driving scheme, luminous flux output from the light emitting device may be readily changed.

Various advantages and effects of the exemplary embodiments are not limited to the above-described descriptions and may be easily understood through explanations of concrete embodiments in the present disclosure.

While exemplary embodiments have been shown and described above, it will be apparent to those skilled in the art that modifications and variations could be made without departing from the scope of the inventive concept as defined by the appended claims.

What is claimed is:

1. A light emitting device comprising:

a plurality of light emitting modules each provided with a circuit board, and first to n-th light source groups disposed on the circuit board, n being an integer greater than two, wherein the first to n-th light source groups each comprise at least one light emitting diode (LED);

a driving module configured to supply driving power to the plurality of light emitting modules, and determine a number of light source groups operating in each of the plurality of light emitting modules based on a level of the driving power; and a module connection unit configured to connect first to n-th light source groups provided in one of the plurality of light emitting modules to first to n-th light source groups provided in another light emitting module in parallel in a detachable manner, respectively.

2. The light emitting device of claim 1, wherein the circuit boards provided in the plurality of light emitting modules, respectively, are physically separated from one another.

3. The light emitting device of claim 1, wherein the circuit board provided in each of the plurality of light emitting modules comprises a wiring pattern, and wherein the first to n-th light source groups provided in each of the plurality of light emitting modules are electrically connected to one another by the wiring pattern.

4. The light emitting device of claim 3, wherein the module connection unit comprises a connector disposed on the circuit board provided in each of the plurality of light emitting modules, and electrically connected to the wiring pattern provided on the circuit board.

5. The light emitting device of claim 4, wherein the connector comprises a plurality of connectors disposed on the circuit board provided in each of the plurality of light emitting modules.

6. The light emitting device of claim 4, wherein the connector is disposed adjacently to an edge of the circuit board provided in each of the plurality of light emitting modules.

7. The light emitting device of claim 2, wherein the circuit board provided in each of the plurality of light emitting modules has a surface on which light source groups provided in each of the plurality of light emitting modules are disposed, and the surface has a polygonal shape.

8. The light emitting device of claim 7, wherein the surface has a regular polygonal shape.

9. The light emitting device of claim 7, wherein the circuit boards provided in the plurality of light emitting modules, respectively, have substantially identical shapes to one another.

10. The light emitting device of claim 7, wherein the circuit boards provided in the plurality of light emitting modules, respectively, are arranged in a honeycomb structure.

11. The light emitting device of claim 1, wherein the driving module comprises a controller configured to control a path of currents applied to the plurality of light emitting modules and flowing to a ground, based on the level of the driving power.

12. The light emitting device of claim 1, wherein the first to n-th light source groups provided in each of the plurality of light emitting modules are connected to one another in series.

13. The light emitting device of claim 12, wherein at least one of the plurality of light emitting modules further includes a resistor unit connected to the first to n-th light source groups in series.

14. The light emitting device of claim 1, wherein the driving module is disposed on the circuit board provided in one of the plurality of light emitting modules.

15. A light emitting device comprising:

a plurality of light emitting modules each comprising first to n-th light source groups, n being an integer greater than two, and physically separated from one another;

a driving module configured to supply driving power to the plurality of light emitting modules, and determine a number of light source groups operating in each of the plurality of light emitting modules, based on a level of the driving power; and a module connection unit configured to connect the first to n-th light source groups provided in each of the plurality of light emitting modules to first to n-th light source groups provided in an adjacent light emitting module in parallel in a detachable manner, respectively.

16. A light emitting device comprising:

a plurality of light emitting modules connected to one another, each of the plurality of light emitting modules comprising a plurality of light source groups, each comprising at least one light source; and a driving module configured to control turn-on and turn-off of the plurality of light source groups based on a level of power input to the driving module, wherein the driving module is configured to turn on a different number of the plurality of light source groups in each of the plurality of light emitting modules as the level of power input is changed.

17. The light emitting device of claim 16, wherein, as the level of the input power is in a selected range, the driving module is configured to turn on the same number of light source groups in the light emitting modules, respectively.

18. The light emitting device of claim 16, wherein at least one of the plurality of light emitting modules and the driving module is disposed on a same circuit board, and the other light emitting modules are disposed on at least one different circuit board and detachably connected to the single circuit board.

19. The light emitting device of claim 16, further comprising a detector configured to detect the level of power input.

* * * * *